US007017898B2

(12) United States Patent
Varzino et al.

(10) Patent No.: US 7,017,898 B2
(45) Date of Patent: Mar. 28, 2006

(54) APPARATUS FOR SECURING A WORKPIECE

(75) Inventors: Robert E. Varzino, Batavia, IL (US); William J. Phillips, Bolingbrook, IL (US)

(73) Assignee: WMH Tool Group, Inc., Elgin, IL (US)

( * ) Notice: Subject to any disclaimer, the term of this patent is extended or adjusted under 35 U.S.C. 154(b) by 27 days.

(21) Appl. No.: 10/375,566

(22) Filed: Feb. 26, 2003

(65) Prior Publication Data

US 2004/0070132 A1 Apr. 15, 2004

Related U.S. Application Data

(60) Provisional application No. 60/361,170, filed on Mar. 1, 2002.

(51) Int. Cl.
*B25B 5/10* (2006.01)

(52) U.S. Cl. ..... 269/246; 269/43

(58) Field of Classification Search ..... 269/246, 269/247, 245, 43, 45, 165, 44
See application file for complete search history.

(56) References Cited

U.S. PATENT DOCUMENTS

| | | | | |
|---|---|---|---|---|
| 449,987 | A | 4/1891 | Wies | |
| 457,710 | A | 8/1891 | Emmert | |
| 488,600 | A * | 12/1892 | Cowell | 269/172 |
| 693,811 | A | 2/1902 | Yonge | |
| 703,376 | A | 7/1902 | Bingham | |
| 777,611 | A | 12/1904 | Dodge | |
| 1,012,226 | A * | 12/1911 | Starrett | 269/224 |
| 1,106,096 | A | 8/1914 | Hunt | |
| 1,497,107 | A | 6/1924 | Lasell | |
| 1,890,114 | A | 12/1932 | Fulton | |
| 2,430,458 | A | 11/1947 | Farrell | |
| 2,559,925 | A | 7/1951 | Barker | |
| 2,704,951 | A | 3/1955 | Petersen | |
| 2,734,409 | A | 2/1956 | Schum et al. | |
| D181,115 | S | 10/1957 | Vogl | |
| 3,007,358 | A | 11/1961 | Vogl et al. | |
| 3,193,277 | A | 7/1965 | Nagamori | |

(Continued)

FOREIGN PATENT DOCUMENTS

| | | |
|---|---|---|
| DE | 328149 | 10/1920 |

(Continued)

OTHER PUBLICATIONS

Wilton Corporation 2001 Catalog (21 pages).

*Primary Examiner*—Lee D. Wilson
(74) *Attorney, Agent, or Firm*—Fitch, Even, Tabin & Flannery

(57) ABSTRACT

An apparatus for securing a workpiece in accordance with the invention, such as a vise, includes a base for supporting the apparatus on a work surface, a back jaw member connected to the base for engaging a first portion of the workpiece secured by the apparatus, and a front jaw member connected to the back jaw member for engaging a second portion of the workpiece secured by the apparatus. The apparatus may include a clutched handle capable of shifting between an engaged position wherein the handle engages and drives a driven member and a disengaged position wherein the handle disengages from the driven member and is freely positionable in both a clockwise and counterclockwise direction with respect to the driven member. The apparatus may also include an accessory capable of being connected to the apparatus in order to perform additional work on a workpiece.

38 Claims, 13 Drawing Sheets

U.S. PATENT DOCUMENTS

| | | | | |
|---|---|---|---|---|
| 3,281,140 | A | 10/1966 | Smierciak | |
| 3,307,843 | A | 3/1967 | Torossian | |
| 3,377,061 | A | 4/1968 | Watson | |
| 3,492,886 | A | 2/1970 | Naureckas | |
| 3,663,005 | A | 5/1972 | Peddinghaus | |
| 3,669,440 | A | 6/1972 | Kartasuk et al. | |
| 3,675,916 | A * | 7/1972 | Kartasuk et al. | 269/69 |
| 3,768,797 | A | 10/1973 | Kartasuk et al. | |
| 4,040,613 | A * | 8/1977 | Kartasuk et al. | 269/247 |
| 4,057,239 | A | 11/1977 | Hopf et al. | |
| 4,534,547 | A | 8/1985 | Cox | |
| 4,830,350 | A | 5/1989 | Kuei | |
| 4,971,301 | A * | 11/1990 | Yang | 269/153 |
| 6,135,435 | A | 10/2000 | Schmitz | |
| 6,347,792 | B1 | 2/2002 | O'Brien | |
| 6,595,508 | B1 * | 7/2003 | Duncan | 269/242 |
| 2004/0070132 | A1 * | 4/2004 | Varzino et al. | 269/246 |

FOREIGN PATENT DOCUMENTS

| | | |
|---|---|---|
| DE | 332373 | 2/1921 |
| DE | 1 099 478 | 2/1961 |
| DE | 2 326 546 | 12/1974 |
| DE | 8907067 | 10/1989 |
| GB | 443381 | 2/1936 |
| GB | 819506 | 9/1959 |
| GB | 956390 | 4/1964 |
| GB | 973387 | 10/1964 |
| GB | 2 063 111 | 6/1981 |
| GB | 2 182 271 | 5/1987 |
| GB | 2 204 264 | 11/1988 |
| GB | 2 214 109 | 8/1989 |
| GB | 2 221 634 | 2/1990 |

* cited by examiner

APPARATUS FOR SECURING A WORKPIECE

CROSS-REFERENCE TO RELATED APPLICATION

This application claims benefit of U.S. Provisional Application No. 60/361,170, filed Mar. 1, 2002.

BACKGROUND OF THE INVENTION

This invention relates generally to an apparatus for securing a workpiece and, more particularly, to a vise having a clutched handle facilitating enhanced control over the handles of the vise and accessories capable of being connected to a vise and used in conjunction therewith.

The tool industry offers a variety of workholding equipment, such as vises, for use with various types of workpieces. One common shortcoming, however, is that the available workholding apparatus do not offer handles that can account for the various space constraints that may exist when working with particularly shaped workpieces, or in certain work areas and environments. For example, some workpieces are of such size and awkward shape that it is difficult, if not impossible, to efficiently use traditional vise handles such as slotted T-shape handles which are typically used for vise spindle handles and vise rotation lock handles (or rotation restraint handles). More particularly, the size and/or shape of workpieces often interfere with the user's ability to operate such handles. Thus, rather than rotating the handle in an efficient one hundred and eighty or three hundred and sixty degree rotation, the workpiece may only allow for the handle to be rotated in smaller degree increments, increasing the amount of time it takes to perform the desired function and/or increasing the amount of difficulty in performing the desired function.

In another example, the work space or work environment may itself make it difficult, if not impossible, to efficiently use traditional vise handles. More particularly, some workholding apparatus work areas, such as drill press mounted vises, are of such limited space that they hinder the operation of the workholding apparatus and its handles. With respect to drill press vises, the table (or bed) of the drill press can prevent the vise handle from being operated in a three hundred and sixty degree rotation and can provide such little space between the handle gripping surface and the surface of the drill press table that the apparatus user has difficulty in obtaining a good grip of the handle.

Another problem associated with traditional workholding apparatus handles is that the handles are not selectively positionable in a variety of different positions in order to provide the apparatus user with the ability to freely reposition the handle to obtain a better grasp and/or leverage to operate the handle. For example, most slotted T-shape handles will not stay in a variety of positions, but rather will slide through the collar of the handle, rotate to an alternate position, or both. More particularly, when a user rotates a slotted T-shape handle to any angle above the horizontal plane, the handle will fall back to the horizontal plane and/or slide through the collar of the slotted T-shape handle.

In addition, current workholding equipment is not equipped to be used in connection with alternate accessories. For example, traditional vises are either used to clamp a workpiece or provide an anvil surface upon which the workpiece may be supported. Thus, traditional vises provide only a minimal amount of useful work and take up a significant amount of work space.

Accordingly, it has been determined that the need exists for an improved apparatus for securing a workpiece which overcomes the aforementioned limitations and which further provide capabilities, features and functions not available in current workholding equipment.

While the invention will be described in connection with a preferred embodiment, it will be understood that it is not intended to limit the invention to that embodiment.

DETAILED DESCRIPTION OF THE PREFERRED EMBODIMENTS

An apparatus for securing a workpiece in accordance with the invention, such as a vise, includes a base for supporting the apparatus on a work surface, such as a bench or table, a back jaw member (or stationary jaw member in the case of a stationary base) connected to the base for providing a first force on the workpiece secured by the apparatus, and a front jaw member (or moveable jaw member) connected to the back jaw member for providing a second force on the workpiece secured by the apparatus. As will be discussed in more detail below, the apparatus may include a clutched handle capable of shifting between an engaged position wherein the handle engages and drives a driven member and a disengaged position wherein the handle disengages from the driven member and is freely positionable in both a clockwise and counterclockwise direction with respect to the driven member. The apparatus may also include an accessory capable of being connected to the apparatus in order to perform additional work on a workpiece.

Figures 6, 7:
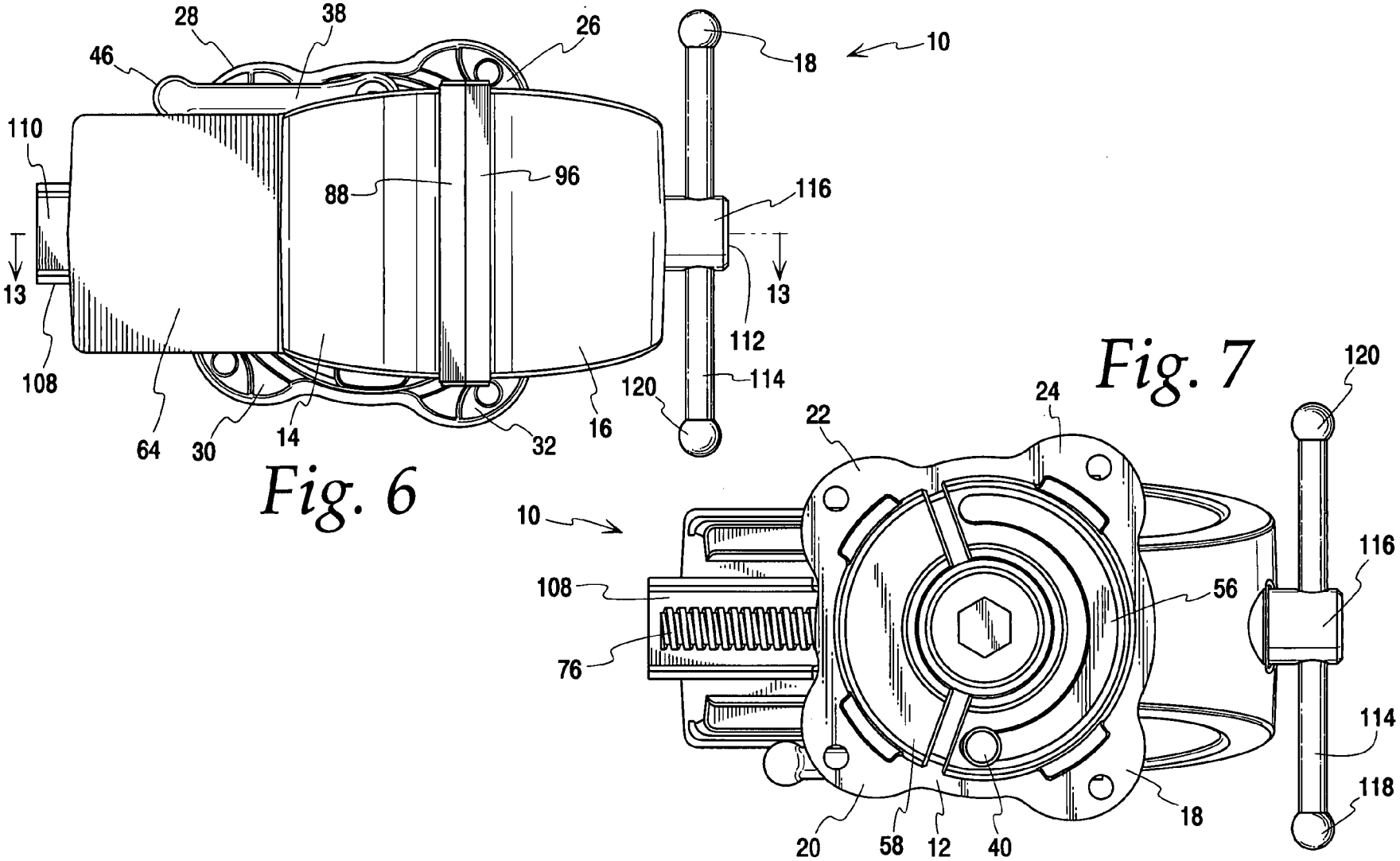
FIG. 6 is a top plan view of the apparatus of FIG. 2, showing the upper surfaces of the jaws and anvil portion of the apparatus.
FIG. 7 is a bottom view of the apparatus of FIG. 2, showing the bottom surface of the swivel base member.
Figure 9:
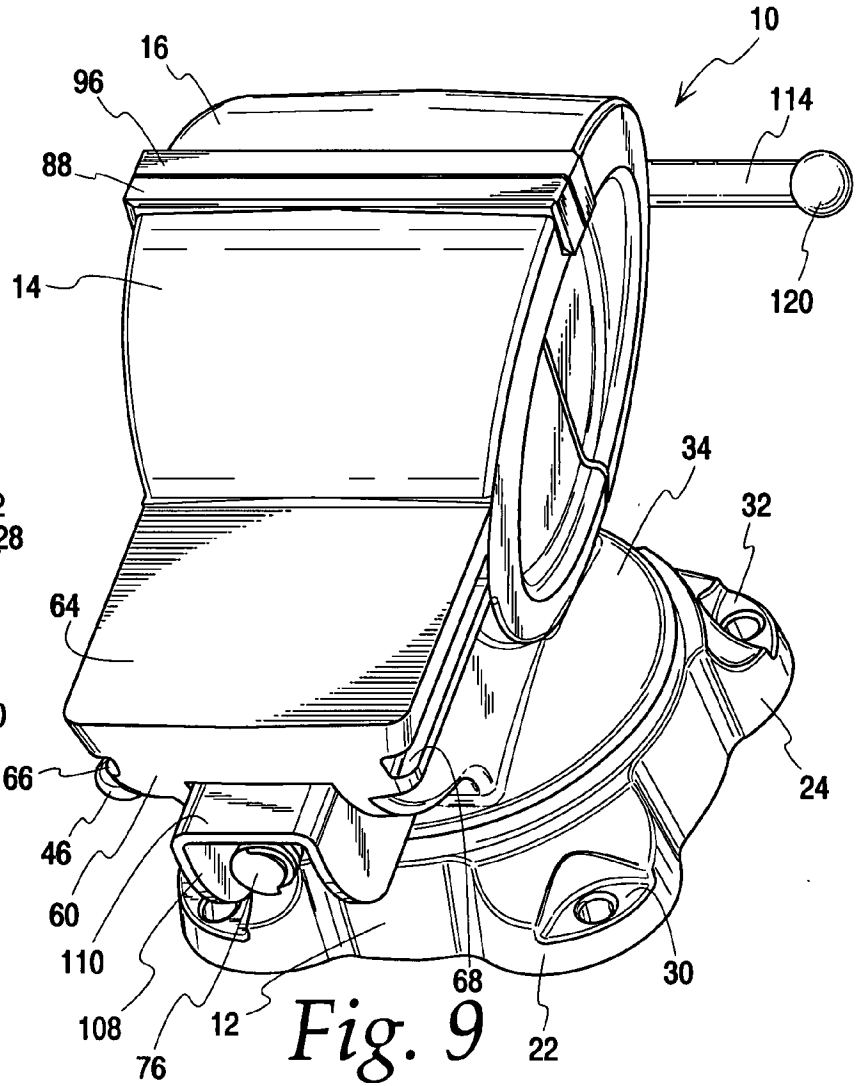
FIG. 9 is a perspective view of the apparatus of FIG. 2, viewed from above and behind the back jaw of the apparatus.
Figure 8:
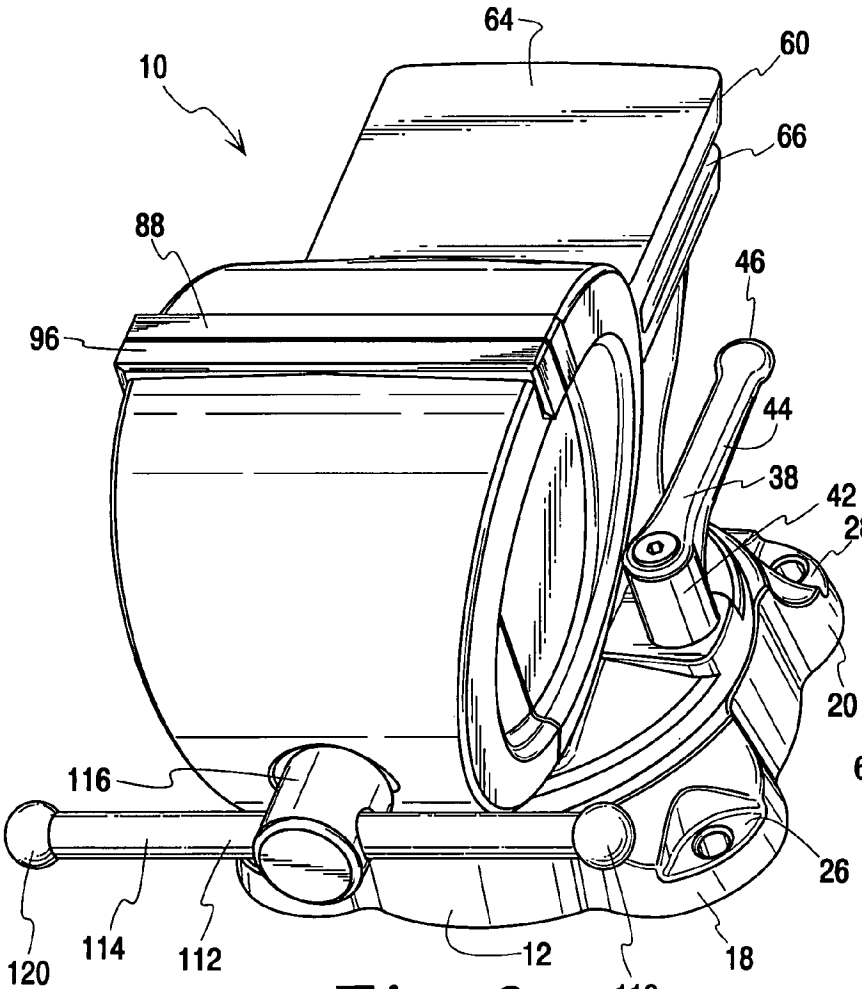
FIG. 8 is a perspective view of the apparatus of FIG. 2, viewed from above and in front of the movable jaw of the apparatus.

In FIGS. 1–14, the apparatus is identified generally by reference numeral 10 and comprises a cast iron vise having a swivel base 12, back jaw member 14 and front jaw member 16. The base 12 has a generally elliptical shape and has four generally arcuate shaped feet 18, 20, 22 and 24 (hereinafter 18–24) extending therefrom. In the embodiment shown, two feet 18 and 20 are located at least partially below the front section of the back jaw member 14, and two feet 22 and 24 are located at least partially below the rear section of the back jaw member 14. The shape of the base enhances stability of the apparatus 10 on the work surface. For example, feet 18 and 24 are larger than feet 22 and 30 and/or set wider apart than feet 22 and 20, in order to enhance the stability of the apparatus for handling larger workpieces positioned between the front and back jaw members 16 and 14. More particularly, the enlarged shape and spacing of the feet 18 and 34, as illustrated in FIG. 7, allow the jaw members to be separated by greater distances and the apparatus to hold larger workpieces without allowing the apparatus to tip over due to the shift in weight away from the center of gravity of the apparatus, (e.g., weight shift due to movement of the front jaw member 16 toward its furthest most open position).

Portions of the upper surface of feet 18–24 are recessed for providing a level surface via which the base may be fastened or secured to the work surface. These recessed level surfaces 26, 28, 30 and 32 (hereinafter 26–32) are ideal for being engaged by a bolt head, a nut, or a washer, to secure the base to the work surface. The countersunk nature of the surfaces 26–32 also allows at least a portion of the fastener used to lie below the curved upper surface of the feet 18–24, thereby reducing the potential of an article catching or snagging the fastener.

The back jaw member 14 is connected to the swivel base 12 and has a lower pedestal portion 34 upon which the main body of the back jaw member rests. The pedestal portion 34 has a generally circular shaped horizontal cross section and is capable of rotating about the base 12 so that the workpiece can be rotated with respect thereto. A raised portion 36 having a generally flat upper surface is provided on the pedestal portion 34 for connecting locking handle 38 to the apparatus 10. The locking handle 38 secures the back jaw member 14 at a desired position with respect to the base 12. More particularly, the upper surface of the raised portion 36 defines an opening through which a gear lock bolt 40 passes. The locking handle 38 has a sleeve portion 42, and an elongated handle portion 44 extending therefrom. The elongate handle portion 44 tappers away from the sleeve 42 and has a rounded end portion 46 for providing an ergonomically desirable handle that is comfortable to grasp, rotate, and raise. The rounded end also allows the operator to "feel" the end of the handle without the need to visually locate it, and provides an additional amount of surface area with which the operator can grasp the handle 38 so that the operator can obtain a better grip and leverage to operate the handle 38.

Figure 11:
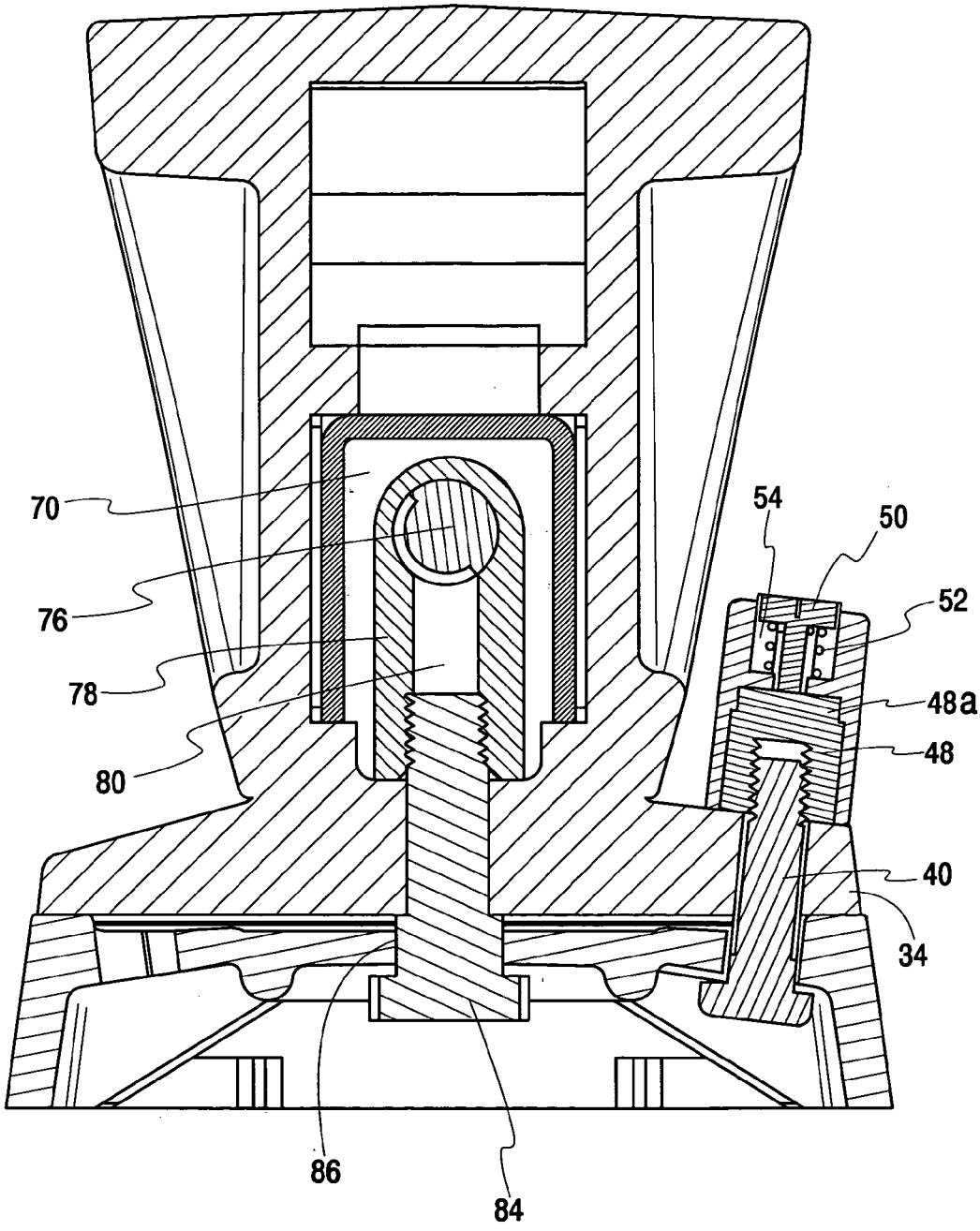
FIG. 11 is a sectional view taken along line 11—11 of the apparatus of FIG. 2, showing the internal keyway or nut located within the back jaw member and the inner workings of the clutched lock down handle.
Figure 12:
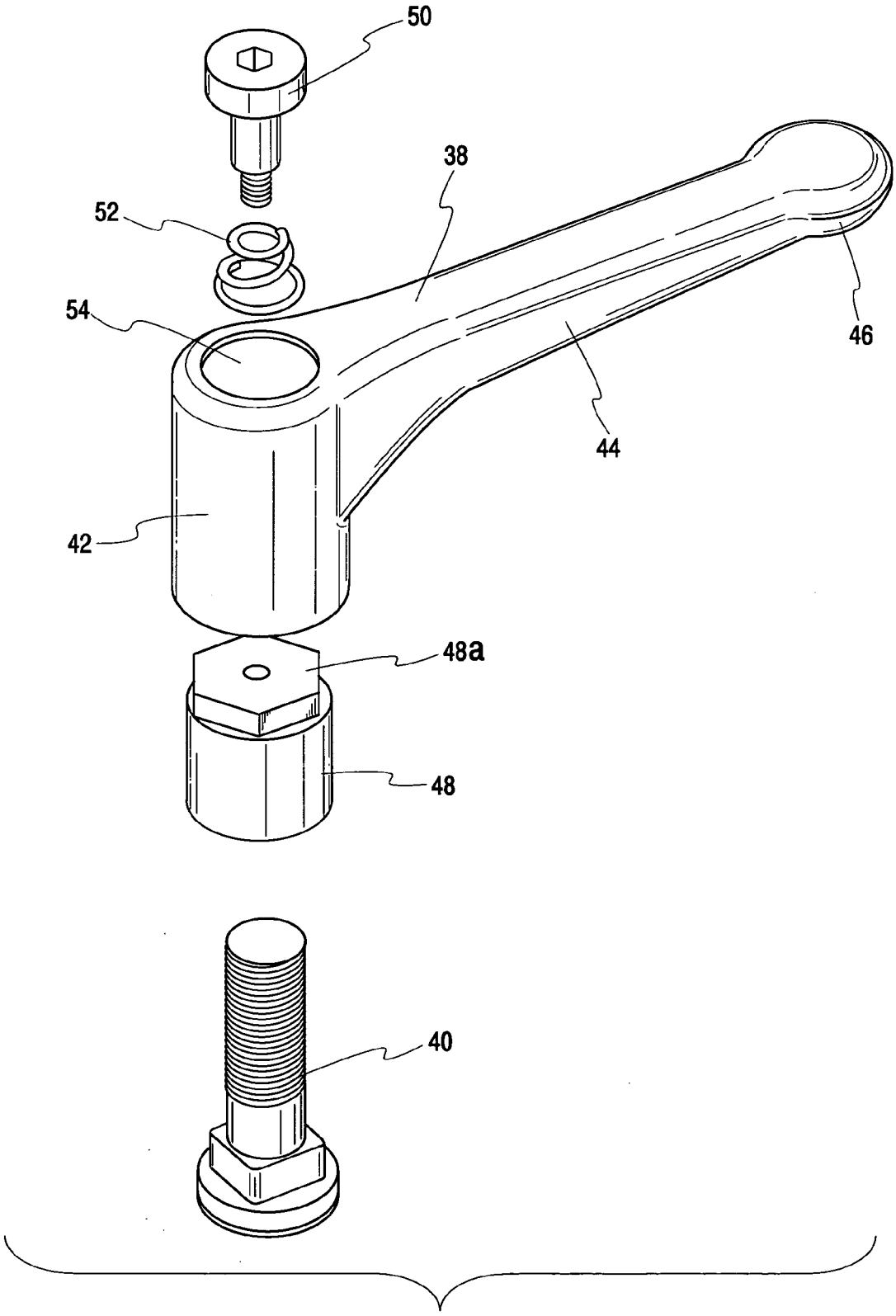
FIG. 12 is an exploded view of the clutched lock down handle of FIG. 11, showing the various elements that make up a preferred clutched handle.

As seen in FIGS. 11 and 12, the sleeve 42 of the lock down handle 38 houses an insert 48 which is internally threaded for receiving the threaded portion of the gear lock bolt 40. The insert 48 is generally cylindrical in shape with a polygonal locking structure 48*a* located near the top thereof. The polygonal locking structure 48*a* defines a threaded bore to mate with the threaded portion of spring bolt 50. The preferred spring bolt 50 is a hex-head type bolt which serves to retain spring 52 in a cup-shaped recess 54, which has an aperture through which the threaded portion of the spring bolt 50 passes or is thread. Located within the sleeve 42 is a mating recess similar in shape to the polygonal locking structure 48*a*. The polygonal locking structure 48*a* is held within the mating recess via the force exerted on the handle 38 from spring 52. Thus, allowing the handle 38 to engage and rotate the insert 48 as desired.

The lock down handle 38 operates as a clutched actuator providing an increased frictional relationship between the back jaw member 14 and the base 12 when operated in one direction, a decreased frictional relationship when operated in the opposite direction, and allowing the handle 38 to be raised and rotated to a plurality of different positions without affecting the relationship between the back jaw member 14 and the base 12. The spring 52 normally biases the actuator handle 38 into engagement with the lock created by insert 48 and bolt 40 so that operation of the handle 38 will result in a corresponding operation of the lock, thereby tightening or loosening the lock. The actuator handle 38 may be shifted against the spring to selectively disengage the mating surfaces of the sleeve 42 and the insert 48 in order for the actuator to be moved without affecting the position of the of the lock and released to re-engage the mating surfaces.

The lock bolt 40 is a shouldered bolt having a polygonal shaped shoulder portion countersunk into the base 12 to prevent the bolt 40 from moving when the handle 38 and insert 48 are in engagement and turned. For example, when the handle 38 is rotated clockwise, the gear lock bolt 40 is thread into the insert 48 and the insert 48 tightens the pedestal 34 against the base 12 thereby increasing the frictional relationship between the back jaw member 14 and the base 12. After enough rotations, the back jaw is effectively secured in one position about the base 12.

When the handle 38 is rotated counterclockwise, the gear lock bolt 40 is thread out of (or removed from) the insert 48 and the insert 48 loosens the pedestal 34 of the back jaw member 14 from the base 12 thereby reducing the frictional relationship between the back jaw member 14 and the base 12. After enough turns, the back jaw member (and front jaw member attached thereto) can be freely rotated about the base 12.

When the apparatus user desires to move the handle 38 without affecting the relationship between the back jaw member 14 and the base 12 (e.g., without rotating the insert 48), he or she need only lift the handle 38 to compress the spring 50 and disengage the sleeve 42 from the insert 48. This orientation allows the handle 38 to be rotated without affecting the relationship between the back jaw member 14 and the base 12. Such handle movement may be desired for a number of reasons. For example, the apparatus user may want to move the handle 38 in this fashion in order to position it out of his or her way or out of the way of the workpiece. Alternatively, the user may want to move the handle 38 in this fashion in order to position it in a location that offers him or her more desirable leverage with respect to the handle 38. Further, the user may want to move the handle 38 in this fashion due to space constraints of the environment in which the user is working or due to space constraints of the workpiece itself. In a preferred embodiment, the clutching action of the handle may be operated regardless of the current state of the relationship between the back jaw 14 and the base 12 (e.g., regardless of whether the jaw members 14 and 16 are effectively secured to the base 12 in one position or are freely moveable about the base 12).

In alternate embodiments, the polygonal locking structure 48*a* may include a multi-toothed gear and the sleeve may include an annular ring having mating teeth located therein which engage one another when the actuator and lock are engaged and clear one another when the actuator and lock are disengaged. More particularly, when engaged, the teeth of the annular ring force the gear and insert to rotate along with the handle. When disengaged, movement of the handle and annular ring do not result in a corresponding movement of the gear and insert.

Unlike ratcheting systems, such as those used in conventional socket wrenches, the actuator and locking mechanism disclosed herein allow the clutched actuator to be engaged and disengaged by simply shifting the handle with respect to the lock, and allow the handle to be freely rotated in any direction (e.g., clockwise or counterclockwise rotation) so as to allow the user to selectively position the handle without limitation or restriction to account for any one of the various space constraints discussed above. Whereas, in a traditional ratchet systems having a socket and handle, the ratchet must either be removed from the driven member in order to reposition the handle in either direction or a switch must be actuated in order to convert the ratchet's transmission from one operating rotational direction to the other. Such restrictions and limitations increase the amount of time it takes to operate the handle and increase the likelihood of the user losing the handle and/or handle components.

In addition, traditional ratchet systems will not allow the user to position the handle in any desired position without taking further steps to ensure that the handle will not inadvertently rotate. For example, gravity will cause a traditional ratchet system to rotate to a vertical position with the handle extending down from the driven member unless the transmission of the ratchet system is adjusted to prevent the rotation in that direction. This restriction further increases the amount of time and effort it takes to operate a ratchet system.

Turning now to FIGS. 7 and 11, when the pedestal portion 34 is rotated about the base 12, the gear lock bolt 40 travels with the pedestal portion 34 about an arcuate path 56 (FIG. 7) defined by an inner portion 44 of the base 12. The path 56 allows for the jaw members 14 and 16 to rotate one hundred eighty degrees (180°) with respect to the base 12. In alternate embodiments, the apparatus 20 may be configured such that the jaw members 14 and 16 can rotate three hundred and sixty degrees (360°) with respect to the base 12 (e.g., by making the path defined by inner portion 44 an annular ring allowing for 360° rotation). In yet other embodiments, a variety of other degrees and directions of rotation may be achieved. The ability to rotate the jaw members 14 and 16 allows the user to rotate the workpiece as desired and expedites the amount of time it takes to work on the workpiece.

The main body of the back jaw member 14 extends up from the pedestal portion 34 and into an anvil portion 60 and a jaw support portion 62. The anvil portion 60 has a generally flat surface 64 upon which an apparatus user may rest and/or strike objects. Located below this surface 64 are accessory slots 66 and 68 which, in the preferred embodiment, are used to anchor various accessories to the apparatus 10. Some of these accessories will be discussed further below with respect to FIGS. 17–22.

In the embodiment shown in FIGS. 1–14, the accessory slots 66 and 68 are in the form of elongated horizontal recesses located within the sides of the anvil portion 60 and are generally parallel to the anvil surface 64. In their anchoring capacity, the accessory slots 66 and 68 are capable of retaining portions of accessories so that additional uses of the apparatus 10 may be had. For example, the ends of a pull-down clamp bracket may be inserted so that the workpiece may be worked on from above via the clamp. An example of this can be seen in FIG. 19.

Figure 19:
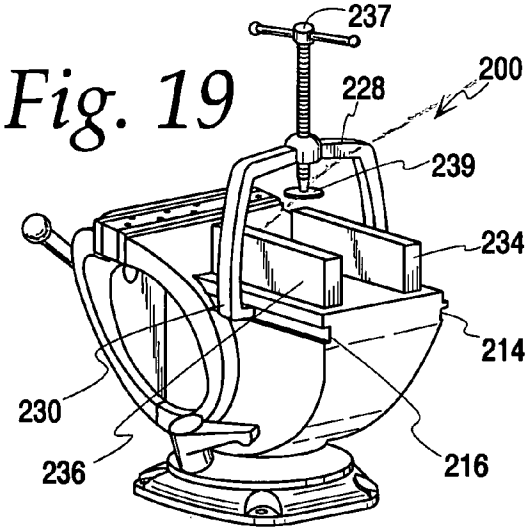
FIG. 19 is a perspective view of an apparatus for securing a workpiece in accordance with the invention viewed at an angle to and above the back jaw of the apparatus and showing a hold down clamp accessory and a work support accessory used in conjunction therewith.

In alternate embodiments, the accessory slots may be used to store various types of accessories to be used with the apparatus 10. For example, work supports, such as spacers or riser bars (as shown in FIG. 19), may be stored within the accessory slots and removed to adjust the height of the workpiece when desired. Alternatively, tools such as a hex-key for tightening and/or loosening the spring bolt 50 may be stored in accessory slots located in the anvil portion of the apparatus or in an alternate accessory slot located about the apparatus.

As can be seen best in FIGS. 1, 3, 9, 11 and 14, the back jaw member 14 also contains an inner region 70 having a channel or passageway 72 through which a beam 108 from the front jaw member 16 and a screw thread or spindle 76 may pass. Within the inner region 70 of the apparatus 10 is a back jaw keyway (or nut) 78. The keyway 78 contains a generally vertical bore or channel 80 and a generally horizontal bore or channel 82 which are internally threaded. The vertical bore 80 is used as a nut for attaching the keyway 78, back jaw member 14, and base 12 together. More particularly, shoulder bolt 84 is fed through openings in the base 12 and back jaw member 14 and threaded into the bore 80. The shoulder bolt 84 has a shoulder or collar portion 86 which allows the jaw member 14 to swivel with respect to the base. Thus, the keyway 78 actually serves as a nut to the bolt connecting the back jaw member 14 to the base 12. The horizontal bore 82 is also used as a nut for receiving the threaded screw or spindle 76 of the apparatus. This configuration will be explained in further detail below with respect to the operation of the apparatus 10.

The jaw support portion 62 of the back jaw member 14 includes an upper or top jaw 88 for holding various types of workpieces and lower jaws, such as pipe jaws 90 and 92, for holding various sizes of rounded objects such as pipes or other objects having non-uniform surfaces. In the embodiment shown, the top jaw 88 is made from hardened steel and the pipe jaws are cast into the apparatus 10 as a permanent fixture. In alternate embodiments, however, a number of different jaws may be used. For example, the top jaw 88 may be replaced with aluminum jaws, fiber jaws, rubber jaws, prism jaws, copper jaws, polyurethane jaws, or the like, depending on the type of workpiece to be secured via the jaw. As an example, if a softer metal is to be secured by the jaw, copper or polyurethane jaws may be used in order to prevent the apparatus from damaging the workpiece.

Furthermore, the face of the jaws may be serrated, smooth, or configured to hold particular types of workpieces. For example, if the apparatus 10 is often used to secure particular types of workpieces, the jaws may be configured specifically for holding that particular material. As an example, if the apparatus 10 is often used to hold piping smaller than that capable of being held in the pipe jaws, the top jaws may contain horizontal or vertical grooves in their face to better secure the workpiece. In some instances, the jaws may be reversible, having a serrated face on one side and a smooth face on the other. In yet other instances, magnetic jaws may be attached to the top jaws for temporary workpiece holding. Such jaws allow the apparatus user to protect both the jaws of the apparatus 10 and the workpiece from marring and distortion during clamping action. Typically these magnetic jaws or caps are constructed with two built-in circular magnets located on the backside of the magnetic jaw attachment to connect the caps to the top jaws of the apparatus 10 and to keep from magnetizing the clamped workpiece and/or collecting metal filings on the face of the caps.

In addition to the versatility of the top jaw, the apparatus 10 may be configured with replaceable pipe jaws 90 and 92 instead of permanent pipe jaws. Such a configuration allows different types of pipe jaws to be used (e.g., aluminum, fiber, rubber, etc.), and can allow for self-centering pipe jaws to be used so that the workpiece is properly secured.

Figure 14:
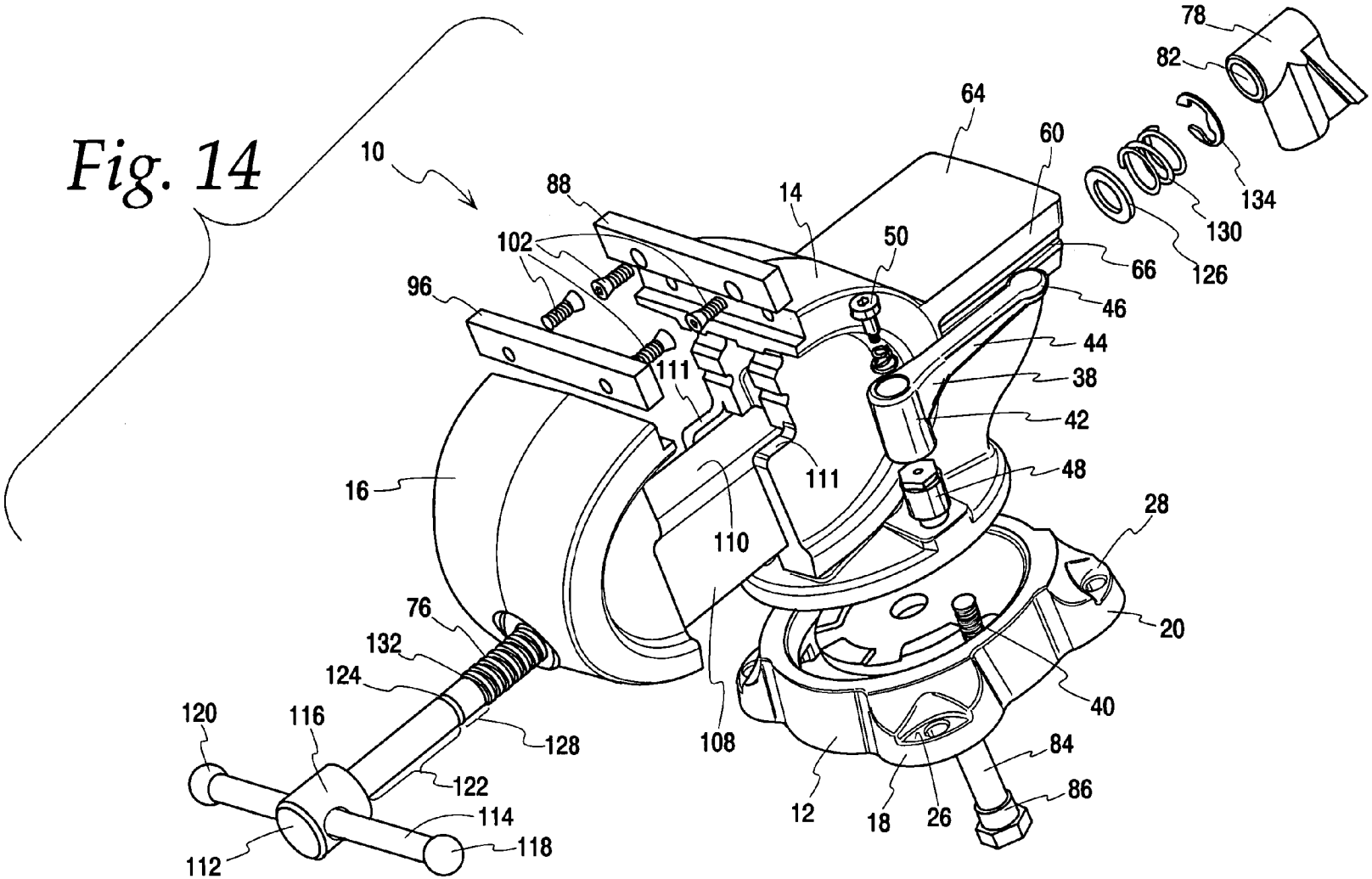
FIG. 14 is an exploded view of the apparatus of FIGS. 1–13, showing various parts of the apparatus.

The front jaw member 16 has a jaw support portion 94 containing top and pipe jaws 96, 98 and 100 similar to those on the back jaw member 14. In the embodiment shown, the top jaw 96 is replaceable and the pipe jaws 98 and 100 are cast into the front jaw member 16. As shown in FIG. 14, the top jaws 88 and 96 are attached to the jaw support portions 62 and 94 via fasteners 102. In the embodiment shown, the fasteners 102 consist of screws which are partially fed through openings in the jaws 88 and 96 and thread into bores located on the jaw support portions 88 and 96. Preferably, at least one of the jaws 88 and 96 have graduated ruler markings on their upper surface so that an apparatus user can make measurements with ease and/or move a workpiece by measured amounts while it is loosely clamped by the apparatus 10. An example of this can be seen in FIG. 18, by looking at the image of the jaws shown through the magnifying lens.

Extending from the lower portion of the front jaw member 16 is the front jaw beam 108 (slide bar or channel beam) which covers and protects the elongated threaded member or screw 76. In the embodiment shown, the jaw beam 108 consists of an elongate horizontal sleeve formed from steel, which is generally U-shaped and covers the top and sides of the screw 76. The upper surface 110 of the beam 108 is generally flat for providing a surface upon which a workpiece can be rested and/or balanced. Furthermore, the edges of the beam 108 are rounded to reduce the risk of scratching or marking a surface of the workpiece. The back jaw has a lip portion 111 which is generally U-shaped and extends out from the main body of the back jaw 14. The lip portion 111 provides support for the beam 108 and provides upper surfaces which are level with the upper surface of the beam 108. This configuration helps strengthen the apparatus 10 and support workpieces resting between the jaw members 14 and 16.

Figure 1:
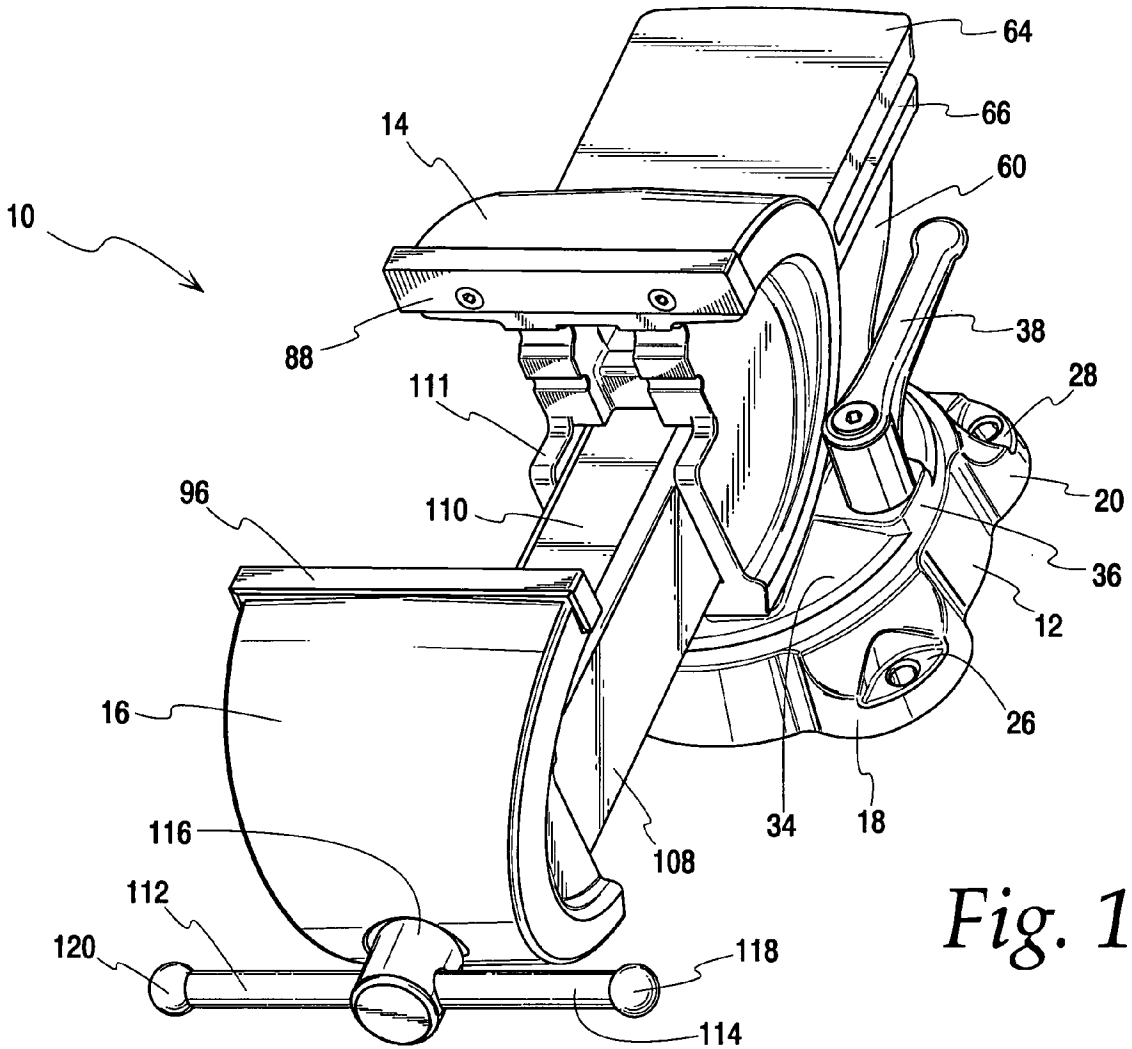
FIG. 1 is a perspective view of an apparatus for securing a workpiece in accordance with the invention.
Figure 3:
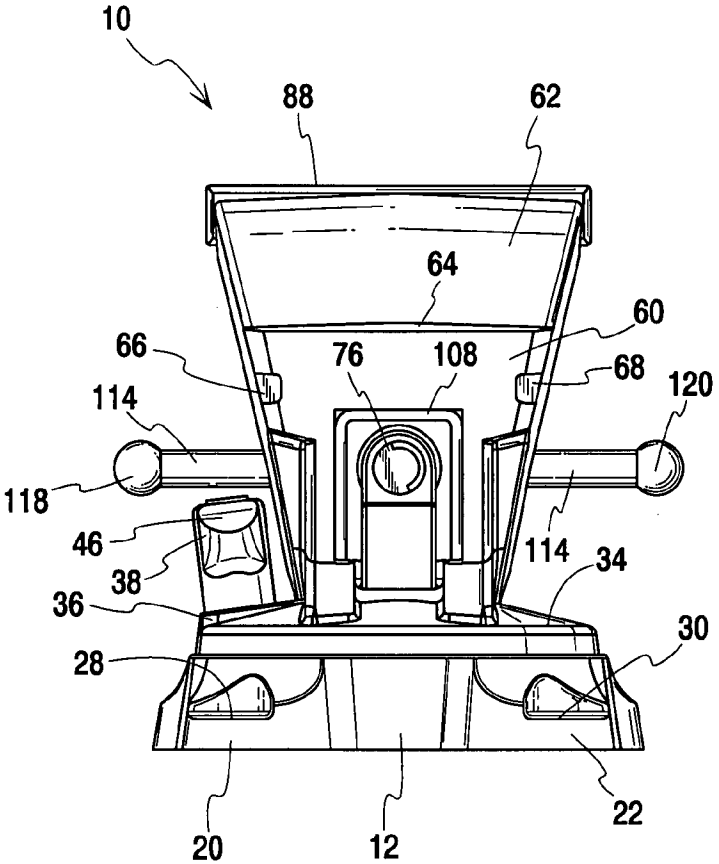
FIG. 3 is a rear elevational view of the apparatus of FIG. 2, showing end views of the anvil portion and accessory slots of the apparatus.
Figure 2:
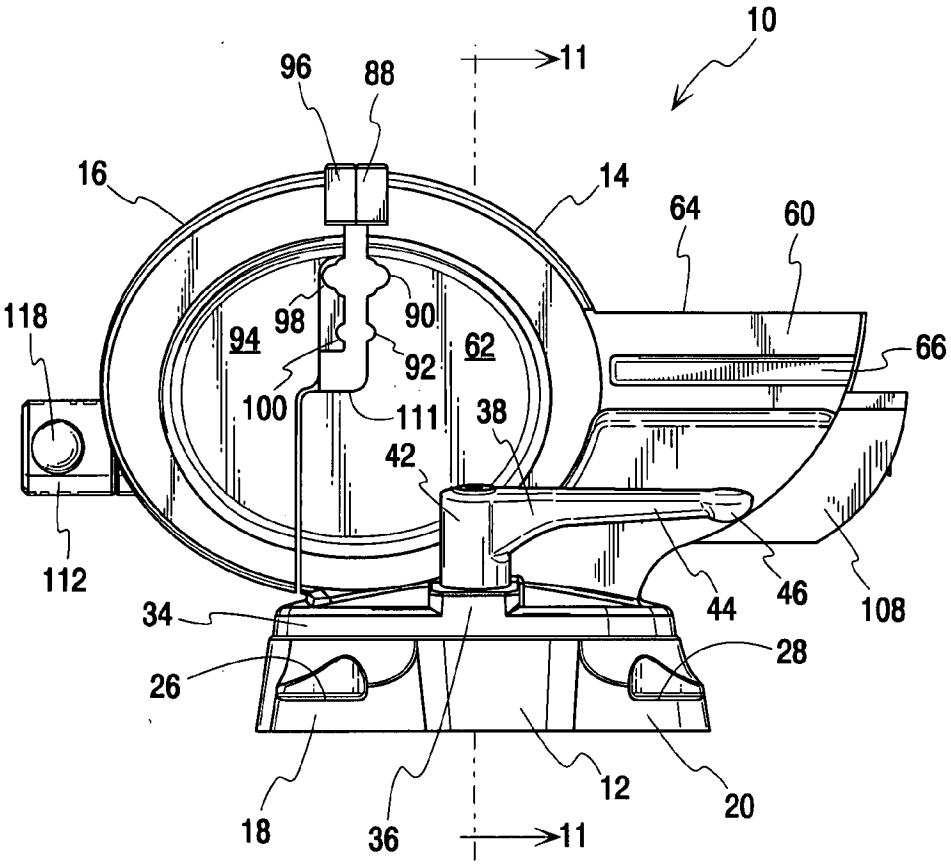
FIG. 2 is left-side elevational view of the apparatus of FIG. 1, showing the jaws of the apparatus fully closed.
Figure 5:
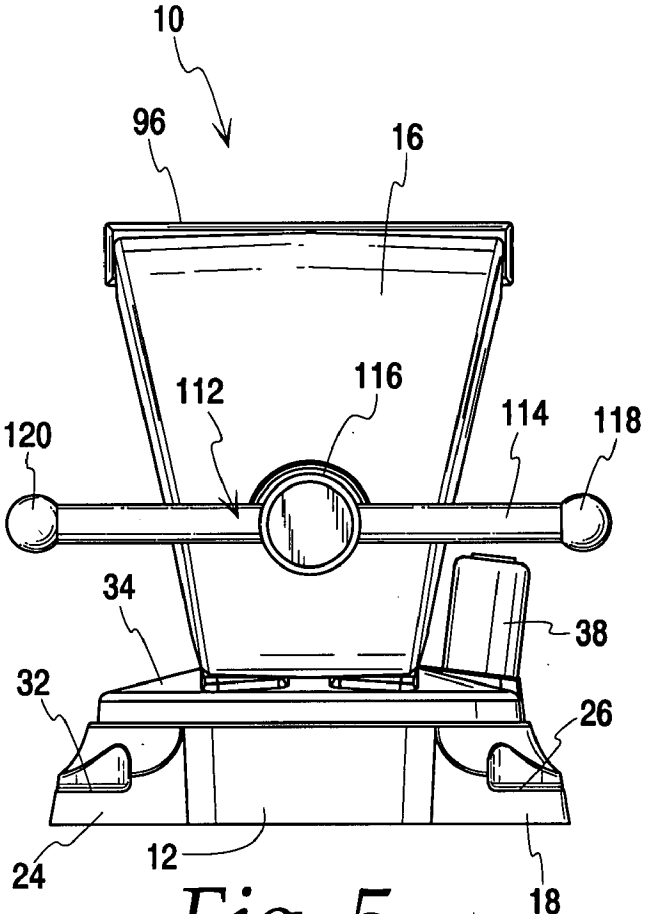
FIG. 5 is a front elevational view of the apparatus of FIG. 2, showing an end view of the T-handle of the apparatus.
Figure 4:
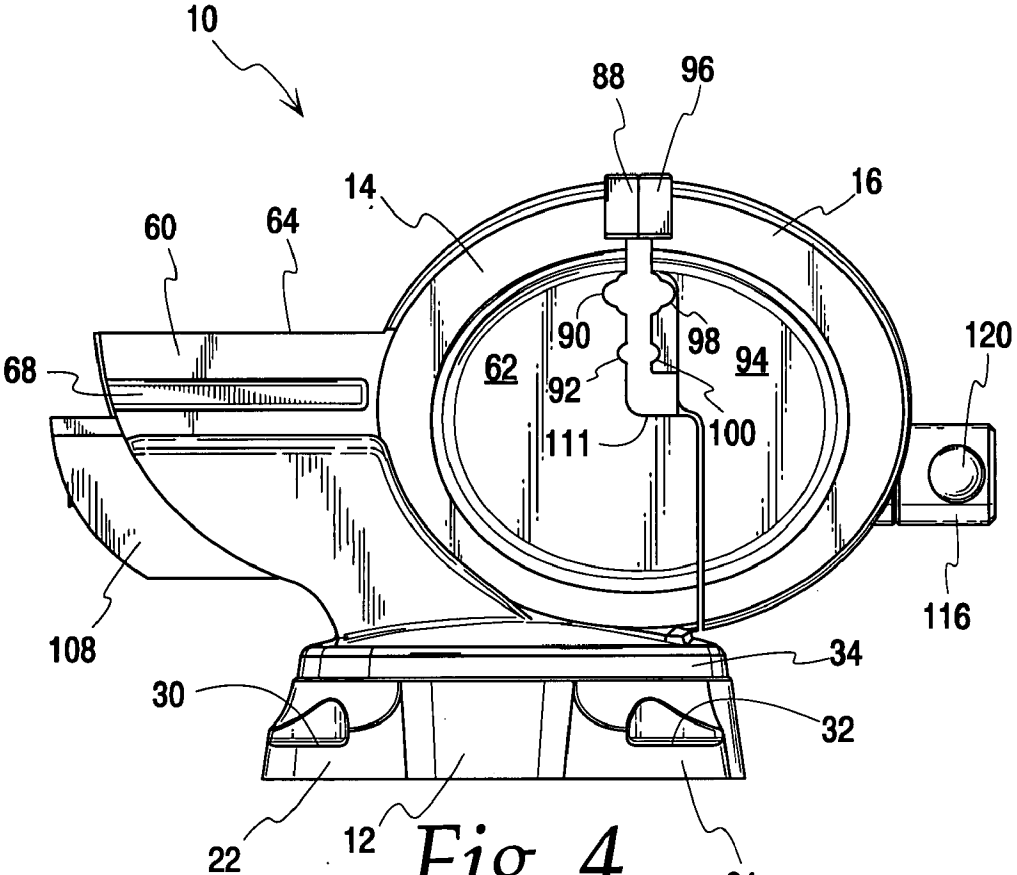
FIG. 4 is a right-side elevational view of the apparatus of FIG. 2, showing the jaws of the apparatus fully closed.
Figure 10:
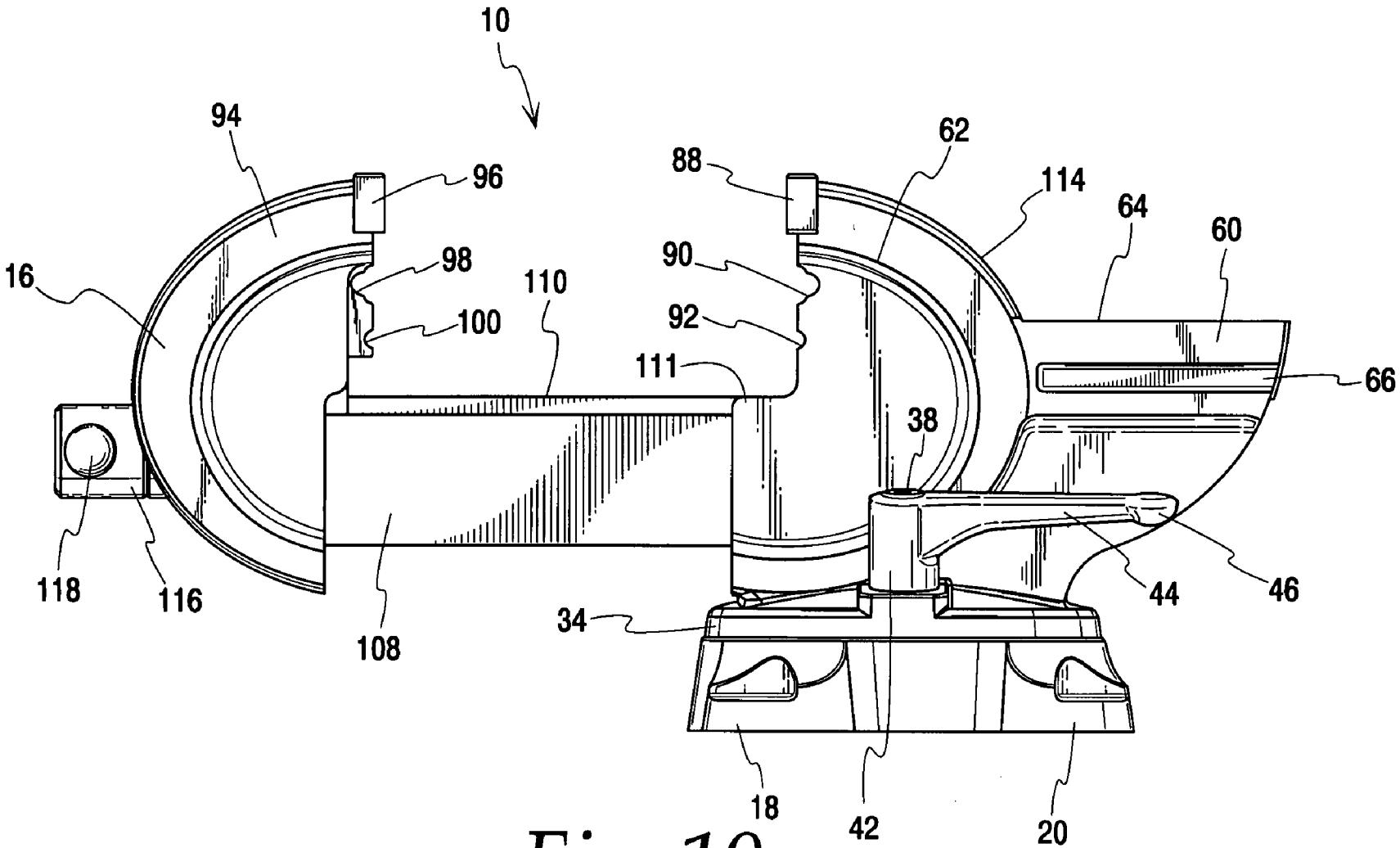
FIG. 10 is a left-side elevational view of the apparatus of FIG. 1, showing the jaws of the apparatus opened.

When the jaws 88 and 96 are in the closed position, a portion of the beam 108 extends out beyond the back jaw member 14, as can be seen in FIGS. 2 and 4. This is not so when the jaws 88 and 96 are fully opened, as can be seen in FIG. 10. Further, in the embodiment shown, the end of the beam that extends out from the back jaw member 14 when the jaws 88 and 96 are fully closed is curved to match that of the outer surface of the back jaw member for esthetic purposes. In the preferred embodiment, a portion of the beam 108 will always be present above the screw 76, in order to prevent anything from being rested on the screw 76 and/or damaging the screw, (e.g., bending the screw, denting the screw threads, etc.).

Figure 13:
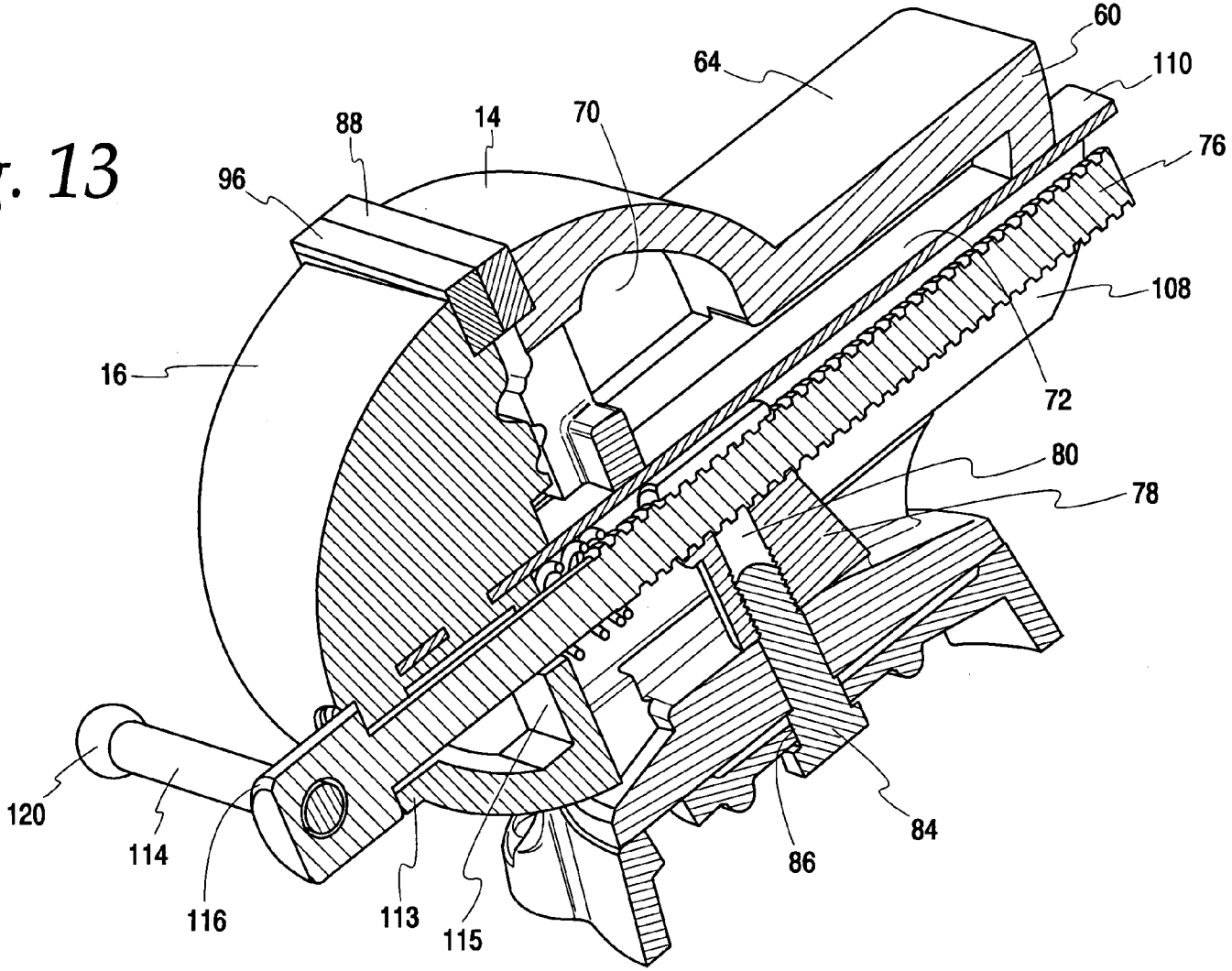
FIG. 13 is a side sectional view taken along line 13—13 of the apparatus of FIG. 6, showing the internal screw and keyway engagement.

The lower portion of the front jaw 16 also includes a passageway through which the screw 76 is passed for connection to the main apparatus handle 112. As can be seen in FIG. 13, the passageway is defined by openings in the outer and inner walls 113 and 115 of the front jaw member 16, and positions the screw 76 in line with the keyway 78 so that the screw 76, when turned, travels in a straight line. This straight line configuration reduces thread wear in the bore 82 of keyway 78 and increases the overall clamping power of the apparatus 10 due to the cooperating engagement between the screw threads and the internal bore threads of the keyway 78.

The main apparatus handle (spindle handle or slotted T-handle) 112 has an elongated lever portion 114 extending through a collar portion 116 of the screw 76. The lever portion 114 contains ball-shaped ends 118 and 120 and can slide through the collar 116 in either direction until one of the ends 118 and 120 abuts the collar 116. This allows the user to increase the length of the lever portion 114 thereby increasing the amount of leverage the user has to rotate the handle 112. This feature also allows the lever portion 114 to be adjusted to account for environmental and/or workpiece space constraints. In the embodiment shown, the screw 76 is made from cold rolled steel and the ball ends 118 and 120 are forged from the handle stock so that they will not come loose. Rubber collars may be positioned about the lever portion 114 near the ball-shaped ends 118 and 120 in order to prevent metal-to-metal contact between the ends 118 and 120 and the collar portion 116.

As shown in FIG. 14, portion 122, which is located adjacent to the collar 116, is non-threaded and rests within the passageways defined by inner and outer walls 115 and 113 of the front jaw member 16. Next to this portion of the screw 76 is a recessed channel 124 within which washer 126 rests. When the screw is inserted in the passageway of the front jaw member 16 and during use of the apparatus, the washer 126 abuts the inner wall 115 of jaw member 16. Adjacent this portion of the screw 76 is another non-threaded portion 128 around which spring 130 is placed. Adjacent portion 128 is another recessed channel 132 within which a locking washer, such as E-ring 134, rests. This locking washer 134 compresses the spring 130 against washer 126, which in turn presses against the inner wall 115 of front jaw member 16. Such a configuration holds the screw 76 into the front jaw member 16 and effectively gives the apparatus 10 a spring loaded handle and screw assembly. Such a configuration helps ensure that there will be immediate engagement between the threaded portion of the screw 76 and the nut 78, and ensures the screw 76 is in proper alignment with the nut 78. These features assist in reducing, if not eliminating, play in the handle 112.

Figure 18:
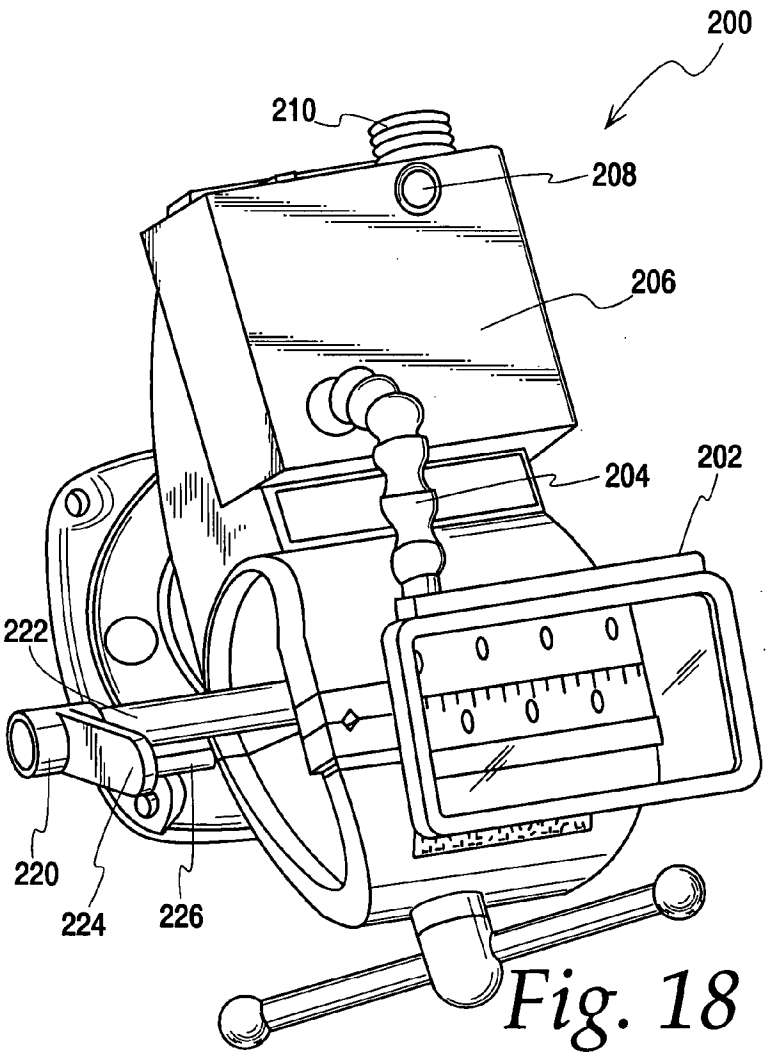
FIG. 18 is a perspective view of the apparatus of FIG. 15 viewed from the side of and above the apparatus, showing additional views of the magnifying lens and workpiece stop accessories used in conjunction therewith.
Figure 17:
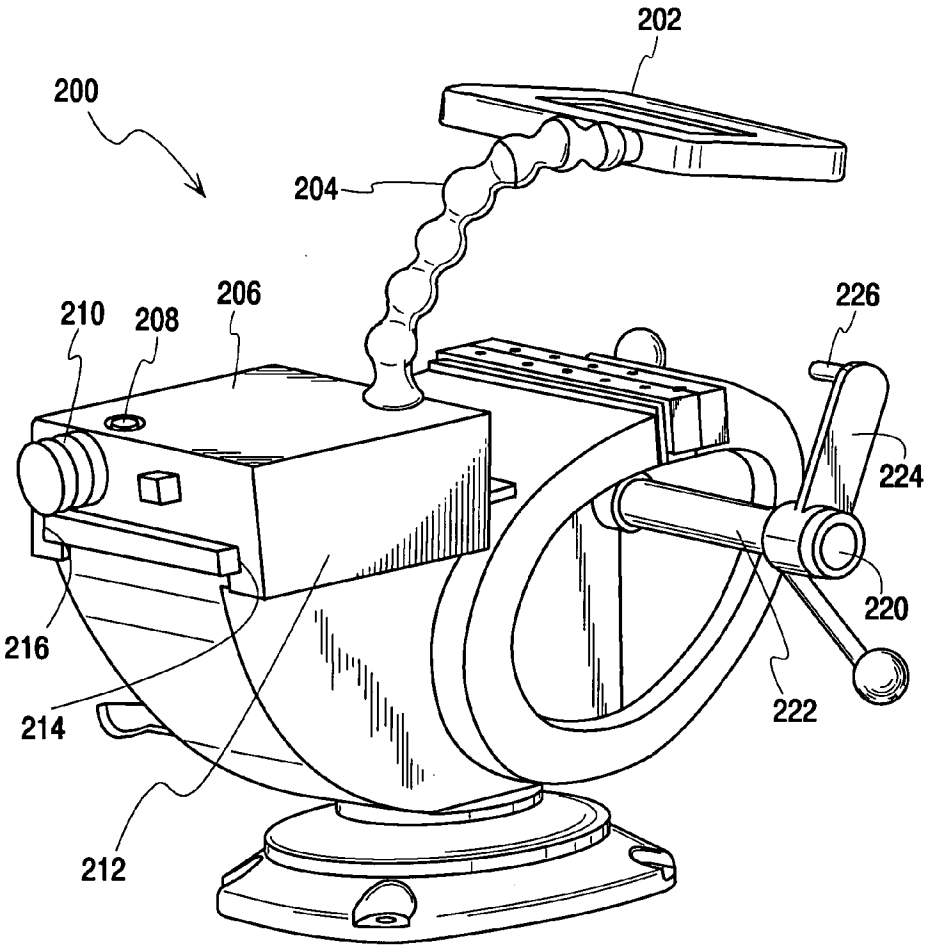
FIG. 17 is a perspective view of an alternate apparatus for securing a workpiece in accordance with the invention viewed at an angle to and above the back jaw of the apparatus and showing a magnifying lens accessory and a workpiece stop accessory used in conjunction therewith.

During operation of the apparatus 10, the handle 112 is rotated in the fashion discussed above in order to open and close the jaws 88, 90, 92, 96, 98 and 100. More particularly, when the handle 112 is rotated clockwise, the screw 76 is thread into the keyway or nut 78 bringing the front jaw support portion 94 closer to the back jaw support portion 62. After enough turns, the jaws 88 and 96 are completely closed preventing additional rotation of the handle. When the handle 112 is rotated counterclockwise, the screw 76 is threaded out of (or backed out of) the nut 78 causing the front jaw support portion 94 to move farther away from back jaw support 62. Such rotation spreads the jaws apart allowing the apparatus 10 to work with larger workpieces. In most applications, the apparatus 10 will be mounted to a work surface such as a bench or table and will be used to clamp a desired workpiece. During other applications, however, the apparatus may be used to spread items apart, (e.g., used as a spreader). For example, vertical bars may be inserted into the holes in the top jaws 88 and 96, (as shown in FIGS. 17 and 18), and the handle 112 may be turned to crank the front jaw member 16 away from the back jaw member 14. With such a configuration, a workpiece separated by the vertical bars would be spread apart as jaw 96 separates or opens from jaw 88.

In alternate embodiments of the invention, the clutched handle described above may be used as the main apparatus handle or spindle handle in order to provide more control over the handles operation. For example, in embodiments having stationary bases, (which means there is no lock down handle), a clutched handle may be provided as the main apparatus handle so that the apparatus user can reposition the handle out of his or her way, or so the user can position the handle in a location where he or she can get more leverage to operate the handle, or so the user can position the handle as required by various environmental space constraints (e.g., space constraints with the work area, space constraints with the workpiece, etc.).

As another example, such a clutched spindle handle may be ideal for vises mounted on a drill press in which the user cannot complete a full rotation of the handle. In such instances, the user can simply rotate the handle as far as he or she can, disengage the handle from the rotating screw or spindle, position the handle back to the desired starting location, and re-engage the handle for further rotation of the screw or spindle.

Such a clutched spindle handle also allows the apparatus user to tighten the jaws of the apparatus to the desired amount and then position the handle so that the lever arm or handle is pointing straight downward. This minimizes the effect gravity can have on the handle and the desired jaw setting. For example, with a traditional spindle handle, the lever of the handle may be left at a position other than pointing straight down when the desired jaw setting has been reached. As such, the weight of the handle in combination with gravity (which is continually trying to return the handle to the position where it points straight downward) may be sufficient to change or affect the desired jaw setting. Use of a clutched spindle handle can avoid such a problem.

Figure 15:
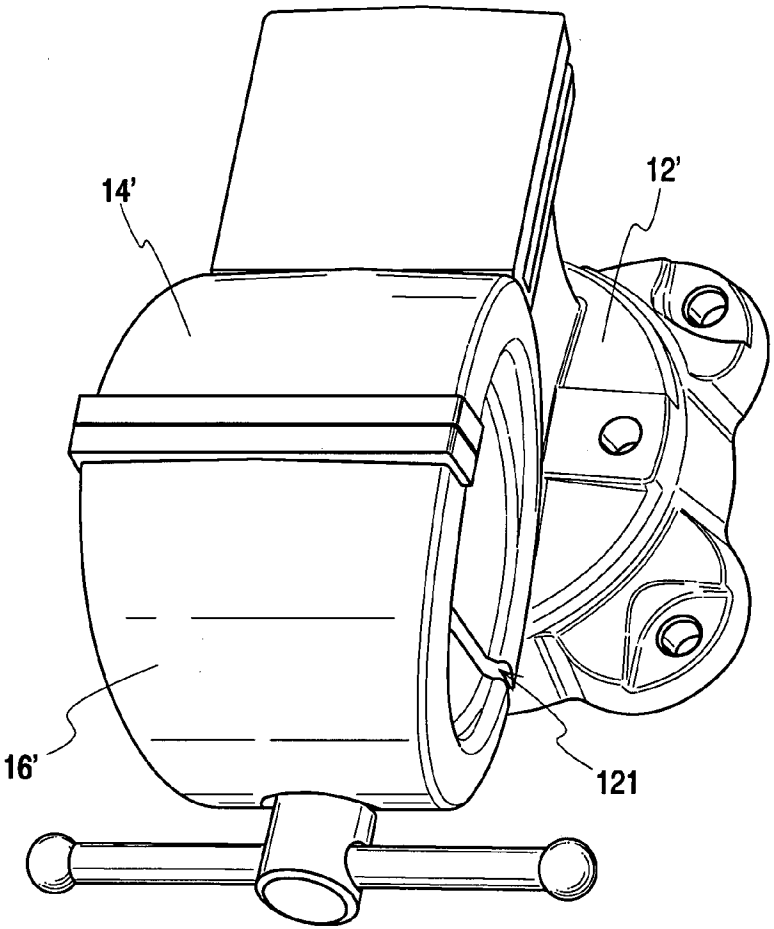
FIGS. 15 and 16 are perspective and side elevational views, respectively, of an alternate apparatus for securing a workpiece in accordance with the invention showing the first and second jaw members aligned so that their opening is positioned off to the side of the apparatus base so that workpieces may be suspended off of the end of the worksurface to which the apparatus is mounted.
Figure 16:
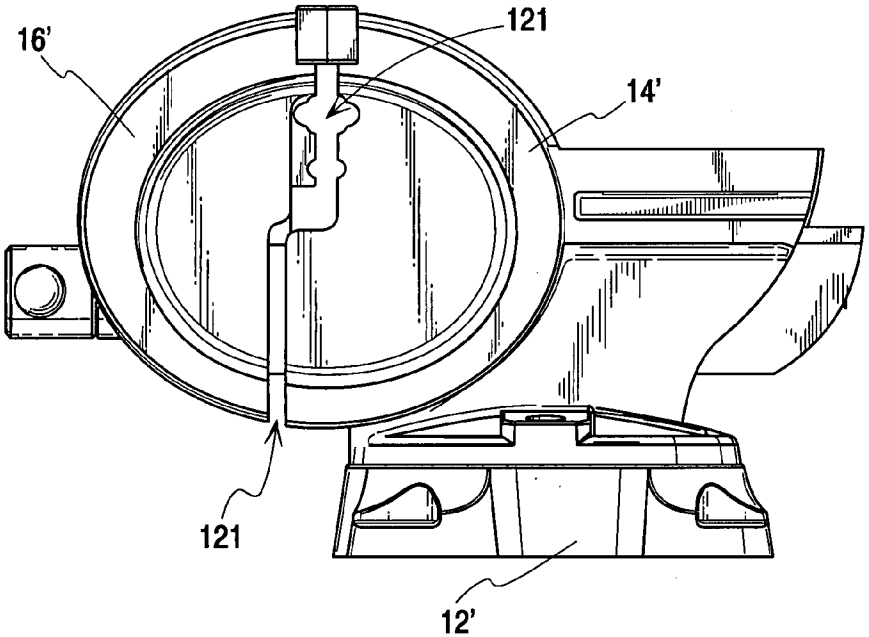

In FIGS. 15 and 16, an alternate apparatus for securing a workpiece in accordance with the invention is shown with the first and second jaw members aligned so that their opening is positioned off to the side of the apparatus base so that workpieces may be suspended off of the end of the worksurface to which the apparatus is mounted or resting on. For convenience, features of the alternate embodiment illustrated in FIGS. 15 and 16 that correspond to features already discussed with respect to the embodiments of FIGS. 1–14 are identified using the same reference numeral in combination with an apostrophe (') merely to distinguish one embodiment from the other, but otherwise such features are similar. The advantage to having the jaw members 14' and 16' aligned with their opening (identified by arrows 121) off to the side of the base 12' is that the apparatus can be used with a workpiece extending off to the side of the worksurface upon which the apparatus is mounted or resting. For example, in one application the apparatus 10' may be used to secure a workpiece extending up from the floor of a workshop and off to the side of a workbench upon which the apparatus 10' is mounted. Thus, the alignment of the jaw members 14' and 16' may be adjusted to provide such capabilities.

Various accessories may be used in conjunction with the apparatus described herein. For example, in FIGS. 17 and 18, an alternate apparatus for securing a workpiece in accordance with the invention is shown generally at reference numeral 200 and is being used in conjunction with a magnifying lens, such as magnifying glass 202. The magnifying glass 202 is connected to an adjustable arm 204 so that it can be positioned over various portions of the apparatus 200, workpiece, and work surface. The arm 204 is connected to a power supply 206 so that the magnifying glass 202 can be illuminated and/or illuminate the region being observed through the magnifying glass 202. The power supply 206 has a power switch 208 and a illumination adjustment knob 210 for adjusting the amount of light given off by the magnifying glass 202. In the embodiment shown, the power supply 206 is battery operated and supplies power from the battery to the illumination device of the magnifying glass 202. In alternate embodiments, the power supply may have a power cord capable of supplying power from an outlet to the illumination device.

The power supply 206 is anchored to the apparatus 200 via braces such as legs 212 which extend down from the bottom or side surface of the power supply 206 and into accessory slots 214 and 216 of the apparatus 200. More particularly, the power supply 206 is slid onto the apparatus 200 so that the ends of the braces 212 slide into the accessory slots 214 and 216. In another embodiment, the power supply 206 may be clamped or fastened to the anvil portion of the apparatus, and/or may contain magnets for attaching the power supply to the apparatus. For example, at least a portion of the bottom of the power supply 206 may be magnetic and capable of connecting the power supply 206 to the apparatus 200. The magnets may be used in conjunction with the clamps or braces mentioned above, or in place of these items.

Another accessory being used with the apparatus 200 is workpiece stop 220, which has an elongated shaft 222 extending into a receiving slot (or accessory slot) located in the main body of the back jaw member, preferably below that member's jaw and near the face of the jaw support portion. In the embodiment shown, the receiving slot extends all the way through the back jaw member. The work stop 220 is adjusted to bring the stop lever 224 and end stop 226 closer to the jaws or farther therefrom. Once the desired position is reached, the workpiece is positioned between the jaws of the apparatus 200 and butted up against the end stop 226. This accessory 220 ensures that a workpiece or multiple workpieces can be returned to the exact position within the vise each and every time the user desires to do so. The receiving slot used for this accessory may be found in either the back jaw member or the front jaw member, as can be seen more clearly in FIGS. 20 and 22, and preferably passes all the way through the entire jaw member so that the workpiece stop 220 can be inserted however far is desired and/or used on either side of the apparatus 200.

In FIG. 19, the apparatus 200 is used in conjunction with a hold down clamp 228, which is anchored to the apparatus 200 via brackets (or legs) 230 and 232, which have ends resting within the accessory slots 214 and 216. With this configuration, a workpiece can be positioned and clamped down onto the anvil portion of the apparatus 200. In some instances, it may be desirable to place work supports, such as spacers or riser bars 234 and 236, underneath the workpiece to raise it a desired amount. For example, if the user intends to drill the workpiece, the user will want to raise the workpiece off of the anvil surface at least a minimal amount so as not to damage the apparatus 200 and/or drill bit once the bit passes through the workpiece. In operation, the user turns the spindle handle 237 thereby moving the clamp 239 closer to or farther from the workpiece.

Figure 20:
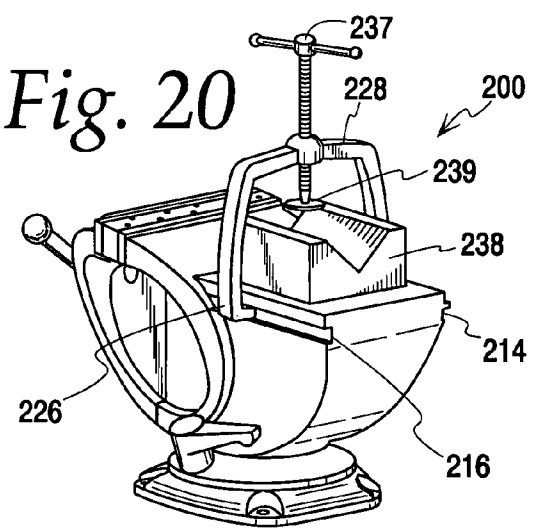
FIG. 20 is a perspective view of an apparatus for securing a workpiece in accordance with the invention viewed from the side of and above the back jaw of the apparatus and showing a hold down clamp accessory and a v-block accessory used in conjunction therewith.

In FIG. 20, the apparatus 200 is used in conjunction with a hold down clamp 228 and a v-block (or 90° workpiece support) 238. Such an accessory 238 is frequently used when the workpiece is round or cylindrical in shape or when the workpiece has corners. With such a configuration, the apparatus can be used to perform one task with the hold down clamps, while allowing the jaw members to be used for another task.

Figure 21:
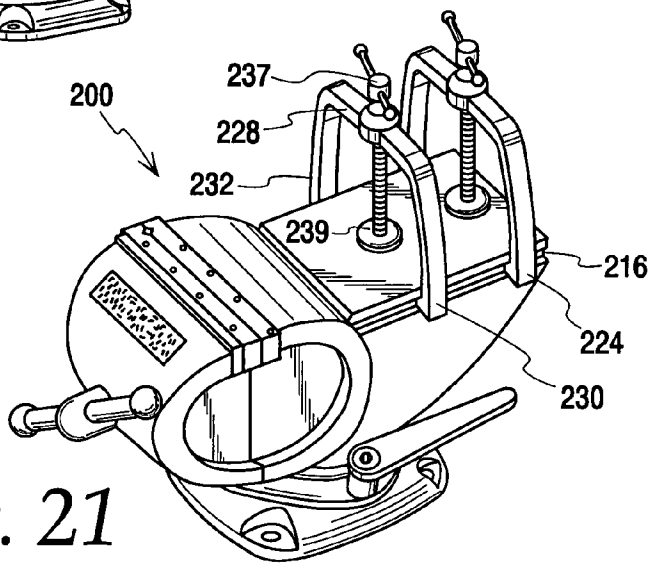
FIG. 21 is a perspective view of an apparatus for securing a workpiece in accordance with the invention viewed from the side of and above the movable jaw of the apparatus and showing hold down clamp accessories used in conjunction therewith.

In FIG. 21, the apparatus 200 is used in conjunction with two hold down clamps 228 and 240. Again, each clamp 228 and 240 is anchored to the apparatus 200 via brackets (or legs) 230, 232, 242 and 244. In this way, the clamps of the hold downs 228 and 240 can be tightened down towards the anvil portion surface area of the vise and can apply pressure to the workpiece located thereon.

Figure 22:
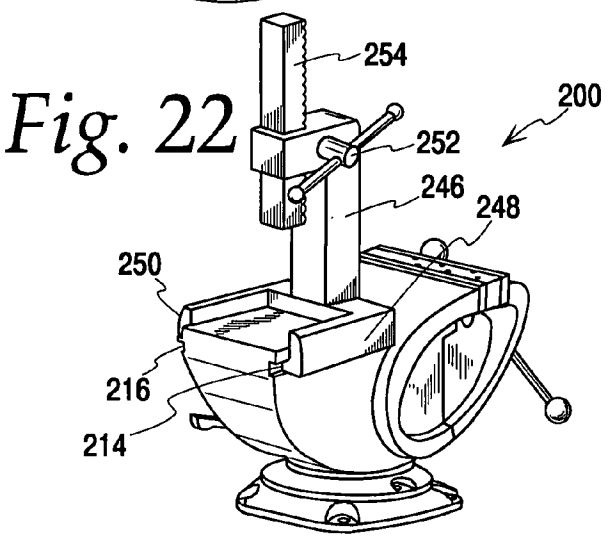
FIG. 22 is a perspective view of an apparatus for securing a workpiece in accordance with the invention viewed at an angle to and above the back jaw and showing an arbor press accessory used in conjunction therewith.

In FIG. 22, the apparatus 200 is used in conjunction with an arbor press 246, which is secured to the apparatus 200 via brackets 248 and 250 and accessory slots 214 and 216. Such an accessory 246 may be used to exert a strong force in a concentrated area of a workpiece. When the user turns the press handle 252 clockwise, the press 254 is lowered down against the workpiece.

The engagement between the accessory and the accessory slots 214 and 216 is essentially wobble free, but allows the ends of the legs or brackets of the accessory to ride freely in and out of the slots 214 and 216. In the case of clamp or arbor press accessories, once the accessory has been positioned within the slots 214 and 216 and the clamp has been lowered into engagement with the workpiece, the ends of the legs or brackets are pulled against the top surface of the slots effectively locking the accessory into its current position within the slot. With respect to the power supply and similar type accessories, the accessory may contain additional clamping members for tightening the accessory against the apparatus 200, or may contain magnets for achieving a similar function.

In the embodiments illustrated in FIGS. 1–22, the lip portions of the accessories that extend into the slots of the apparatus are complimentary in shape to the slots. In a preferred form, the accessories are removed from the apparatus by sliding the accessories off the end of the anvil portion of the apparatus. However, in alternate embodiments, the lip portions may be made of a resilient material which allows the lip portions to be temporarily deformed so that the accessories can be lifted up off the anvil portion rather than slid off its side. For example the accessory could be lifted directly up from the apparatus causing both lip portions to deform simultaneously, or the accessory could be removed from the slots by removing the lip portions one side at a time.

In alternate embodiments, other mortise and tenon, or tongue and groove, configurations may be used to connect the accessories to the apparatus. For example, the apparatus and accessories may be connected to one another via a dovetail joint configuration, (e.g., a flaring tenon and mortise configuration). In yet other embodiments, the mortises may be located in the accessory and the tenons located on the apparatus, or the accessories may have both tenon and one mortise portions and the apparatus may have complimentary mortise and tenon portions. Thus, it should be understood that a variety of joints or connections may be used to connect the accessories to the apparatus, (e.g., such as magnetic bases as discussed above with respect to FIGS. 17 and 18).

Furthermore, although some of the more useful accessories for use with an apparatus for securing a workpiece have been discussed and/or illustrated, one of ordinary skill in the art should know that a plurality of other accessories may be used in conjunction with the apparatus given its novel accessory connection apparatus and methods. Thus it is apparent that there has been provided, in accordance with the invention, an apparatus for securing a workpiece that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for securing a workpiece comprising:

a base;

a first jaw supported by the base and being capable of movement relative to the base;

a second jaw being capable of movement toward and away from the first jaw;

a drive interconnecting the first and second jaws, the drive being capable of actuation to selectively move the second jaw toward and away from the first jaw to support a workpiece;

a lock interconnecting the base and the first jaw and having a lock position that prevents the first jaw from being moveable relative to the base and a release position that permits the first jaw to move relative to the base; and an actuator connected to the lock and moveable between a first position wherein the actuator is in driving engagement with the lock and capable of moving the lock between the lock and release positions, and a second position wherein the actuator is disengaged from the lock and incapable of moving the lock between the lock and release positions.

2. An apparatus in accordance with claim 1 wherein the lock applies a clamping force between the first jaw and the base when in the lock position.

3. An apparatus in accordance with claim 2 wherein the lock includes at least one mating surface and the actuator includes at least one complementary mating surface, the mating surfaces engage to shift the lock between the lock and release position.

4. An apparatus in accordance with claim 3 further comprising a spring to bias the mating surfaces into engagement.

5. An apparatus for securing a workpiece comprising:

a base;

a first jaw supported by the base and being capable of movement relative to the base;

a second jaw being capable of movement toward and away from the first jaw;

a drive interconnecting the first and second jaws, the drive being capable of actuation to selectively move the second jaw toward and away from the first jaw to support a workpiece;

a lock interconnecting the base and the first jaw and having a lock position that prevents the first jaw from being moveable relative to the base and a release position that permits the first jaw to move relative to the base;

an actuator connected to the lock and that can be moved to shift the lock between the lock and release positions and that can be moved without affecting the lock, wherein the actuator can be manually shifted against the spring to selectively disengage the mating surfaces in order for the actuator to be moved without affecting the position of the lock and released to re-engage the mating surfaces.

6. An apparatus in accordance with claim 5 wherein the lock includes a clamping member which applies a clamping force against the first jaw in the lock position to prevent movement of the first jaw relative to the base, the clamping member having the at least one mating surface of the lock.

7. An apparatus in accordance with claim 6 wherein the actuator includes a socket to receive at least a portion of the clamping member and the socket having the at least one mating surface of the actuator.

8. An apparatus in accordance with claim 7 wherein the clamping member includes at least two mating surfaces and the socket includes at least two complementary mating surfaces.

9. An apparatus in accordance with claim 7 wherein the actuator includes an elongated handle portion.

10. An apparatus in accordance with claim 9 wherein the first jaw defines a first aperture, the base defines a second aperture and the lock includes an elongated member extending through the apertures to interconnect the base, the first jaw and the clamping member.

11. An apparatus in accordance with claim 10 wherein the second aperture is elongated to permit the lock to move with the first jaw relative to the base when the lock is in the release position.

12. An apparatus in accordance with claim 11 wherein the second jaw swivels relative to the base, and the second aperture is arcuate to permit the lock to move with the first jaw relative to the base when the lock is in the release position.

13. An apparatus in accordance with claim 12 wherein the elongated member is in the form of a bolt, the bolt having an enlarged head at one end and threads at the other end, at least a portion of the socket of the clamping member having threads, the threaded end of the bolt threads into the threaded portion of the socket and the clamping member and the enlarged end of the bolt clamp the base and first jaw together to prevent the jaw member from moving relative to the base when the lock is in the lock position.

14. An apparatus for securing a workpiece, comprising:

a base for supporting the apparatus on a work surface;

a first jaw member connected to the base for engaging a first portion of a workpiece;

a second jaw member connected to the first jaw member and movable with respect thereto for engaging a second portion of the workpiece;

a threaded shaft connecting the first and second jaw members and being capable of moving the second jaw member with respect to the first jaw member; and a clutched handle connected to the apparatus and capable of shifting between an engaged position wherein the handle engages and drives a driven member and a disengaged position wherein the handle disengages from the driven member and is freely positionable in both a clockwise and counterclockwise direction with respect to the driven member.

15. An apparatus according to claim 14 wherein the base is a swivel base allowing at least one of the first and second jaw members to be rotated with respect thereto.

16. An apparatus according to claim 15 wherein the driven member is a lock connecting the base and the first jaw member in a frictional engagement and the clutched handle is capable of adjusting the frictional engagement between the base and the first jaw member when the handle is in the engaged position and is capable of being positioned in a plurality of different positions without affecting the frictional engagement between the base and first jaw member when the handle is in the disengaged position.

17. An apparatus according to claim 16 wherein the clutched handle includes a recess for receiving a portion of the lock when the handle is in the engaged position.

18. An apparatus according to claim 17 wherein the clutched handle further comprises a spring member for normally biasing the handle in the engaged position.

19. An apparatus according to claim 14 wherein the driven member is the threaded shaft connecting the first and second jaw members and the clutched handle is capable of driving the threaded shaft in a rotational motion when the handle is in the engaged position and is capable of being positioned in a plurality of different positions without engaging the threaded shaft when the handle is in the disengaged position.

20. An apparatus according to claim 14 wherein the base comprises four feet with first and second feet being located on a side of the base opposite the second jaw member and generally positioned below the first jaw member and third and fourth feet being located on a side of the base near the second jaw member and being spaced farther apart than the first and second feet are from one another.

21. An apparatus according to claim 20 wherein the third and fourth feet are larger in size than the first and second feet and all feet contain recessed surfaces for receiving one of a bolt head and nut.

22. An apparatus according to claim 14 wherein the apparatus further comprises an accessory for use with the apparatus, the accessory being capable of being connected to the apparatus in order to perform work on the workpiece.

23. An apparatus according to claim 22 wherein the accessory comprises one of a magnifying lens, clamp and press.

24. An apparatus according to claim 22 wherein the apparatus includes at least one of a mortise and tenon and the accessory includes at least one of a complimentary tenon and mortise for connecting the accessory to the apparatus.

25. An apparatus according to claim 24 wherein the tenon and mortise connection between the apparatus and the accessory comprises a dovetail joint.

26. A vise comprising:

a base;

a jaw assembly having first and second jaws which may be used to clamp or spread apart a workpiece, wherein at least a portion of the jaw assembly is supported by the base and movable relative thereto;

a lock interconnecting the base and the supported jaw assembly and having a lock position that prevents the supported jaw assembly from being moveable relative to the base and a release position that permits the supported jaw assembly to move relative to the base; and an actuator connected to the lock and moveable between a first position wheiein the actuator is in driving engagement with the lock and capable of moving the lock between the lock and release positions, and a second position wherein the actuator is disengaged from the lock and incapable of moving the lock between the lock and release positions.

27. A vise in accordance with claim 26 wherein the lock includes at least one mating surface and the actuator includes at least one complementary mating surface, and the mating surfaces engage to shift the lock between the lock and release positions when the actuator is in the first position and disengage when the actuator is in the second position.

28. A vise in accordance with claim 27 further comprising a spring to bias the mating surfaces into engagement and wherein the actuator can be manually shifted against the spring to selectively disengage the mating surfaces in order for the actuator to be moved to the second position and released to be returned to the first position.

29. A vise according to claim 26 further comprising an accessory for use with the vise, the accessory being capable of being connected to the vise in order to perform work on a workpiece.

30. A vise according to claim 29 wherein the accessory comprises at least one of a magnifying lens, clamp and press.

31. An apparatus for securing a workpiece, comprising:

a base for supporting the apparatus on a work surface;

a first jaw member connected to the base for engaging a first portion of a workpiece;

a second jaw member connected to the first jaw member and movable with respect thereto for engaging a second portion of the workpiece;

a threaded shaft connecting the first and second jaw members and being capable of moving the second jaw member with respect to the first jaw member; and a clutched handle connected to the apparatus and capable of shifting between an engaged position wherein the handle engages and drives a driven member and a disengaged position wherein the handle disengages from the driven member and is incapable of driving the driven member.

32. An apparatus according to claim 31 wherein the base is a swivel base allowing at least one of the first and second jaw members to be rotated with respect thereto and the driven member is a lock connecting the base and the first jaw member in a frictional engagement, the clutched handle being capable of adjusting the frictional engagement between the base and the first jaw member when the handle is in the engaged position and being capable of being positioned in a plurality of different positions without affecting the frictional engagement between the base and first jaw member when the handle is in the disengaged position.

33. An apparatus according to claim 32 wherein the clutched handle includes a recess for receiving a portion of the lock when the handle is in the engaged position and the clutched handle further comprises a spring member for normally biasing the handle in the engaged position.

34. An apparatus according to claim 31 wherein the driven member is the threaded shaft connecting the first and second jaw members and the clutched handle is capable of driving the threaded shaft in a rotational motion when the handle is in the engaged position and is capable of being positioned in a plurality of different positions without engaging the threaded shaft when the handle is in the disengaged position.

35. An apparatus according to claim 31 wherein the apparatus further comprises an accessory for use with the apparatus, the accessory being capable of being connected to the apparatus in order to perform work on the workpiece.

36. An apparatus according to claim 35 wherein the accessory comprises one of a magnifying lens, clamp and press.

37. An apparatus according to claim 35 wherein the apparatus includes at least one of a mortise and tenon and the accessory includes at least one of a complimentary tenon and mortise for connecting the accessory to the apparatus.

38. An apparatus for securing a workpiece comprising:

a base;

a first jaw supported by the base and being capable of movement relative to the base;

a second jaw being capable of movement toward and away from the first jaw;

a drive interconnecting the first and second jaws, the drive being capable of actuation to selectively move the second jaw toward and away from the first jaw to support a workpiece;

a lock interconnecting the base and the first jaw and having a lock position that prevents the first jaw from being moveable relative to the base and a release position that permits the first jaw to move relative to the base; and an actuator connected to the lock and moveable between a first position wherein rotational movement of the actuator results in movement of the lock between the lock and release positions and a second position wherein the same rotational movement of the actuator does not result in the same movement of the lock between the lock and release positions.

* * * * *

UNITED STATES PATENT AND TRADEMARK OFFICE

CERTIFICATE OF CORRECTION

PATENT NO. : 7,017,898 B2
DATED : March 28, 2006
INVENTOR(S) : Robert E. Varzino et al.

It is certified that error appears in the above-identified patent and that said Letters Patent is hereby corrected as shown below:

Column 14,
Line 6, change “movable” to -- moveable --.
Line 63, change “complimentary” to -- complementary --.

Column 15,
Line 6, change “movable” to -- moveable --.
Line 14, change “wheiein” to -- wherein --.
Line 43, change “movable” to -- movable --.

Column 16,
Line 30, change “complimentary” to -- complementary --.

Signed and Sealed this

Sixteenth Day of May, 2006

JON W. DUDAS
*Director of the United States Patent and Trademark Office*